US007642718B2

(12) United States Patent
Kim et al.

(10) Patent No.: US 7,642,718 B2
(45) Date of Patent: Jan. 5, 2010

(54) PLASMA DISPLAY PANEL WITH WIDER AND NARROWER DISPLAY REGIONS

(75) Inventors: Taewoo Kim, Yongin-si (KR); Sanghoon Yim, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 415 days.

(21) Appl. No.: 11/452,084

(22) Filed: Jun. 13, 2006

(65) Prior Publication Data

US 2007/0001605 A1 Jan. 4, 2007

(30) Foreign Application Priority Data

Jun. 14, 2005 (KR) ..... 10-2005-0051005

(51) Int. Cl.
*H01J 17/49* (2006.01)

(52) U.S. Cl. ..... 313/582; 313/292; 313/609; 313/586; 313/587

(58) Field of Classification Search ..... 313/582–587, 313/292, 238, 609
See application file for complete search history.

(56) References Cited

U.S. PATENT DOCUMENTS 5,825,128 A * 10/1998 Betsui et al. ..... 313/582
6,376,986 B1 * 4/2002 Takagi et al. ..... 313/582
2001/0026255 A1 * 10/2001 Sano et al. ..... 345/60
2004/0150339 A1 * 8/2004 Klein et al. ..... 313/582
2005/0046350 A1 3/2005 Su et al.
2005/0057172 A1 3/2005 Su et al.
2005/0093449 A1 * 5/2005 Su et al. ..... 313/584
2005/0134175 A1 * 6/2005 Chen et al. ..... 313/582
2005/0174057 A1 * 8/2005 Su ..... 313/583
2006/0186812 A1 * 8/2006 Su et al. ..... 313/582

FOREIGN PATENT DOCUMENTS

JP 2003-011615 1/2003
KR 10-2002-0090389 A 12/2002
KR 1020020090389 A 12/2002
KR 10-2005-0100096 A 10/2005

* cited by examiner

*Primary Examiner*—Toan Ton
*Assistant Examiner*—Kevin Quarterman
(74) *Attorney, Agent, or Firm*—Knobbe Martens Olson & Bear LLP

(57) ABSTRACT

A plasma display panel having a reduced number of address electrodes to decrease power consumption while maintaining the same resolution is disclosed. First and second address electrodes are assigned to a pixel comprising three sub-pixels which are near one another. The first address electrode is assigned to two of the three sub-pixels and the second address electrode is assigned to the remaining sub-pixel. As a result, address electrode capacitance is reduced, and accordingly, cross-talk, power consumption, instantaneous power, and heat generation decrease significantly while maintaining the same display resolution.

20 Claims, 3 Drawing Sheets

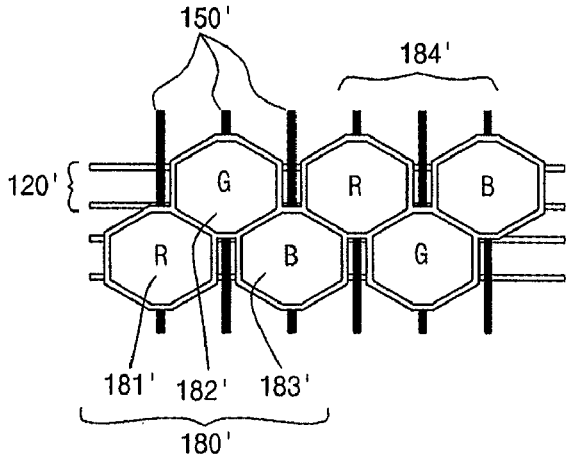
FIG. 3 (PRIOR ART)
FIG.4
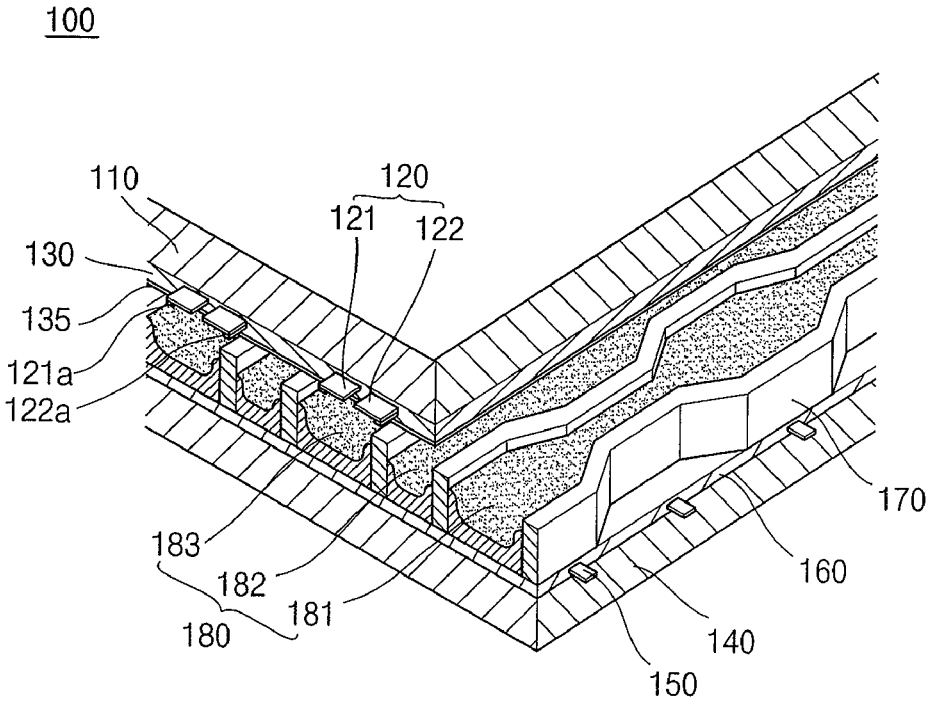

PLASMA DISPLAY PANEL WITH WIDER AND NARROWER DISPLAY REGIONS

CROSS-REFERENCE TO RELATED APPLICATIONS

This application claims the benefit of Korean Patent Application No. 2005-00051005, filed on Jun. 14, 2005, in the Korean Intellectual Property Office, the disclosure of which is incorporated herein by reference.

BACKGROUND OF THE INVENTION

1. Field of the Invention

The present invention relates to a plasma display panel, and more particularly, to a plasma display panel having a reduced number of address electrodes to decrease power consumption while maintaining the same resolution.

2. Description of the Related Technology

In general, plasma display panels display images using a gas discharge phenomenon. They have excellent display capabilities including display capacity, luminance, contrast, afterimage, and viewing angle, and thus, they are prime candidates to replace CRTs. In plasma display panels, light is generated by excitation of a gas between electrodes with DC or AC voltage. The resulting UV radiation excites fluorescent substances located between the electrodes and the fluorescent substances emit light.

FIG. 1 is an exploded perspective view briefly showing a conventional plasma display panel. As shown in FIG. 1, a conventional plasma display panel 100' includes front and rear glass substrates 110' and 140'. The front glass substrate 110' has a number of display electrodes 120' (X display electrodes 121' and Y display electrodes 122') formed parallel on the lower surface thereof. The display electrodes 120' are covered with a first dielectric layer 130'. The first dielectric layer 130' has a protective layer 135' formed on a surface thereof to protect the display electrodes 120' and the first dielectric layer 130' from discharge. The display electrodes 120' have low-resistance bus electrodes 121*a*' and 122*a*' formed on a surface thereof to reduce voltage drop.

The rear glass substrate 140' has a number of address electrodes 150' formed parallel to one another on the upper surface thereof to supply address signals. The address electrodes 150' have a second dielectric layer 160' formed thereon, the second dielectric layer 160' having a thickness sufficient to protect the address electrodes. The second dielectric layer 160' has barriers 170' formed on a surface thereof, and the barriers 170' face one another so as to define discharge regions therebetween. The address electrodes 150' are positioned in the regions between the respective barriers 170' and are generally parallel to them. The address electrodes 150' cross over the display electrodes 120'.

The barriers 170' have a shape as shown in FIG. 1 such that they define discharge regions and minimize discharge interference in the vertical direction. In addition, fluorescent layers 180' are formed on the second dielectric layer 160' over the address electrodes 150' and between the barriers 170', and are configured to be excited by UV rays and emit a predetermined color of light. For example, the fluorescent layers 180' may include red fluorescent layers 181', green fluorescent layers 182', and blue fluorescent layers 183'.

FIG. 2 is a diagrammatic view showing the relationship among the address electrodes, display electrodes, and barriers of the plasma display panel shown in FIG. 1. As shown in FIG. 2, the address electrodes 150' are positioned between the barriers 170' and are generally parallel to them. The display electrodes 120' cross the address electrodes 150' and the barriers 170'. Red, green, and blue fluorescent layers 181', 182', and 183' are formed between the barriers 170'. FIG. 2 shows seven columns of address electrodes 150', five rows of display electrodes 120', and eighteen sub-pixels.

FIG. 3 is a diagrammatic view showing the relationship among the address electrodes, display electrodes, and pixels of the plasma display panel shown in FIG. 1.

As shown in FIG. 3, conventional address electrodes 150' are configured in such a manner that each of three sub-pixels constituting a pixel 184' has its own address electrode 150' assigned to it. For example, a red fluorescent layer 181', forming a red sub-pixel, has an address electrode 150' assigned thereto, a green fluorescent layer 182', forming a green sub-pixel, has another electrode 150' assigned thereto, and a blue fluorescent layer 183', forming a blue sub-pixel, has another electrode 150' assigned thereto.

A conventional plasma display panel 100', constructed as above, performs address discharge by applying a voltage higher than discharge initiation voltage between the X display electrodes 121' and the address electrodes 150'. In addition, the electrical potential of the Y display electrodes 122' is adjusted to temporarily generate discharge between the X and Y display electrodes 121' and 122' so that a charge builds up on each of the X and Y display electrode's surface. Such a charge build up on the X and Y display electrodes 121' and 122' due to address discharge is generally referred to as a wall charge. After the address discharge, a pulse voltage lower than the discharge initiation voltage is applied to the region between the X and Y display electrodes 121' and 122', in order to maintain discharge between the X and Y display electrodes 121' and 122', on which a wall charge has built up due to the address discharge. Such discharge between the X and Y display electrodes 121' and 122' is also referred to as a trickle discharge and occurs only to display electrodes 120' on which a wall charge has built up due to address discharge. The trickle discharge emits UV rays, which excite fluorescent substances and generate a certain color of light.

As the resolution of plasma display panels increases, the number of address electrodes increases and the pitch, or spacing between any two adjacent electrodes among them decreases. A decrease in pitch among address electrodes increases capacitance of address electrodes and the amount of power consumed in driving the address electrodes increases, as the power is approximately calculated as $CV^2f$, where C is the capacitance of the address electrodes, V is the voltage, and f is the frequency at which the voltage is changing. That is, in order to manufacture high-resolution plasma display panels, increase in power consumption of address electrodes has been an undesirable result. Since the discharge voltage applied to the address electrodes is substantially higher than in the case of the display electrodes, increase in capacitance of the address electrodes is directly linked with significant increase in overall power consumption of the plasma display panels.

In the case of full high definition (HD), for example, 1920 pixels (5760 sub-pixels) are necessary for horizontal resolution. In order to meet this requirement, the number of address electrodes is 5760, because each sub-pixel must have its own address electrode assigned thereto, as mentioned above. As a result, the distance between address electrodes decreases, the capacitance of the electrodes increases, the power consumption of plasma display panels increases severely, and cross-talk between the address electrodes increases. In addition, the instantaneous power (or peak power) which must be supplied by a circuit for example, tape carrier package(TCP), so as to apply a predetermined voltage to the address electrodes increases and heat generated by the circuit or panel rises drastically.

SUMMARY OF CERTAIN INVENTIVE ASPECTS

Certain inventive aspects include a plasma display panel having a reduced number of address electrodes so as to decrease power consumption, instantaneous power (or peak power), cross-talk, and heat generation while maintaining the same resolution.

One embodiment is a plasma display panel including a plurality of barriers defining a plurality of display regions. The plurality of display regions include wider regions and narrower regions, where the wider regions and the narrower regions alternate horizontally in rows and alternate vertically in columns, where each row of the horizontally alternating wider regions and narrower regions is between adjacent barriers, and the vertically alternating wider regions and narrower regions are separated by the plurality of barriers. The panel also includes at least one address electrode vertically crossing a column of vertically alternating wider regions and narrower regions, where adjacent wider and narrower regions crossed by the address electrode are separated by the plurality of barriers.

Another embodiment is a plasma display panel device configured to display first, second and third colors. The device includes a plurality of barriers defining a plurality of display regions. Each display region is configured to emit light of one of the first color, the second color, and the third color. The device also includes at least one address electrode arranged such that the address electrode crosses at least one display region configured to emit light of the first color, at least one display region configured to emit light of the second color, and at least one display region configured to emit light of the third color.

BRIEF DESCRIPTION OF THE DRAWINGS

The above and other objects, features and advantages of certain embodiments will be more apparent from the following detailed description taken in conjunction with the accompanying drawings, in which:

FIG. 3 is a diagrammatic view showing the relationship among address electrodes, display electrodes, and pixels of the plasma display panel shown in FIG. 1;

FIG. 4 is a perspective view showing a plasma display panel according to one embodiment;

DETAILED DESCRIPTION OF CERTAIN INVENTIVE EMBODIMENTS

Figure 1:
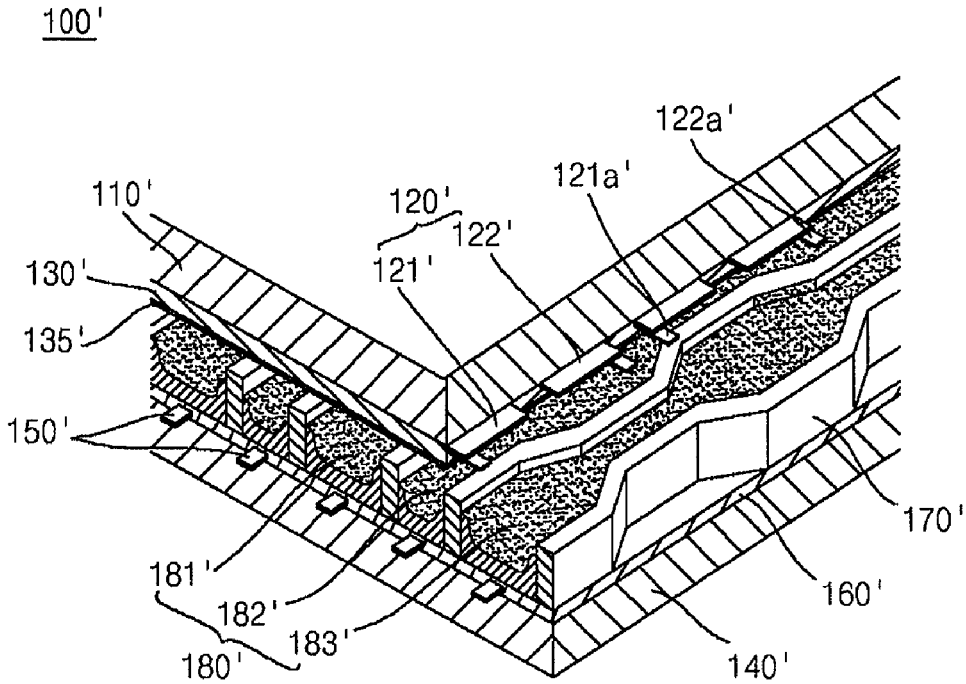
FIG. 1 (PRIOR ART)
FIG. 1 is a perspective view showing a conventional plasma display panel.
Figure 2:
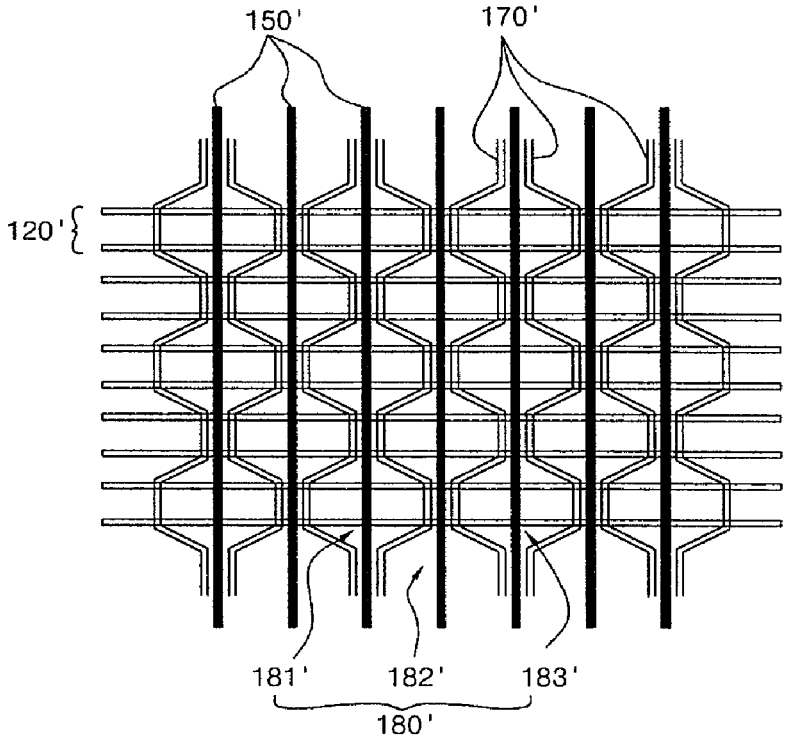
FIG. 2 (PRIOR ART)
FIG. 2 is a diagrammatic view showing the relationship among address electrodes, display electrodes, and barriers of the plasma display panel shown in FIG. 1.

Hereinafter, certain embodiments of the present invention will be described with reference to the accompanying drawings. In the following description and drawings, the same reference numerals are used to designate the same or similar components, and so repetition of the description on the same or similar components will be omitted.

FIG. 4 is a perspective view showing a plasma display panel according to one embodiment. As shown in FIG. 4, a plasma display panel 100 according to one embodiment includes a front glass substrate 110, display electrodes 120 formed on the front glass substrate 110, a first dielectric layer 130 covering the display electrodes 120, a rear glass substrate 140 positioned to face the front glass substrate 110, address electrodes 150 formed on the rear glass substrate 140, a second dielectric layer 160 covering the address electrodes 150, barriers 170 formed on the second dielectric layer 160 with a predetermined thickness, and fluorescent layers 180 formed between the barriers 170.

The front glass substrate 110 may be made of substantially planar glass, may have excellent heat-resistance and/or may have a high strain point so that its size and shape remain substantially unchanged in various high-temperature processes.

The display electrodes 120 are positioned on the lower surface of the front glass substrate 110 and are substantially parallel to one another. For example, the display electrodes 120 may be arranged in a number of rows with a predetermined pitch. A pair of display electrodes 120 comprises an X display electrode 121 and a Y display electrode 122. The display electrodes 120 may comprise at least one of ITO (alloy oxide film of In and Sn), nesa film ($SnO_2$), and an equivalent thereof, which has apropriate optical transmittance and conductance, but the material is not limited to these. The display electrodes 120 may be formed, for example, by sputtering, but the formation method is not limited. The display electrodes 120 may have low-resistance bus electrodes 121*a* and 122*a* formed on a surface thereof to avoid voltage drop. The bus electrodes 121*a* and 122*a* may comprise at least one of Cr—Cu—Cr, Ag, and an equivalent, but the material is not limited to these.

The first dielectric layer 130 covers the entire lower surface of the front glass substrate 110 including the display electrodes 120. The first dielectric layer 130 may be formed by uniform screen printing of paste, which includes low-melting point glass powders as its main component, throughout the lower surface of the front glass substrate 110. The first dielectric layer 130 is transparent, and acts as a capacitor dielectric during discharge and limits the discharge current. The first dielectric layer 130 may have a protective film 135 formed on a surface thereof to reinforce its durability and enable it to effectively emit secondary electrons during discharge. The protective film 135 may comprise at least one of MgO and an equivalent thereof and may be formed using an electrode beam or by sputtering, but the material and formation method of the protective film are not limited.

The rear glass substrate 140 is positioned to face the front glass substrate 110. Particularly, the rear glass substrate 140 is positioned beneath the first dielectric layer 130. The rear glass substrate 140 may be made of substantially planar glass having excellent heat-resistance and a high strain point so that its size and shape remain substantially unchanged in various high-temperature processes.

The address electrodes 150 are positioned on the upper surface of the rear glass substrate 140 facing the first dielectric layer 130. The address electrodes 150 are positioned on the upper surface of the rear glass substrate 140 with a predetermined pitch, and are substantially parallel to one another. For example, the address electrodes 150 are arranged in a number of rows with a predetermined pitch. The address electrodes 150 cross over the display electrodes 120. For example, in some embodiments the address electrodes 150 are approximately perpendicular to the display electrodes 120, and do not touch them. As will be described later, the address electrodes 150 also cross over the barriers 170. The display electrodes 120 are substantially parallel to the barriers 170. The address electrodes 150 may comprise Ag paste or an equivalent thereof and may be positioned using a screen printing method or by photolithography, but the material and formation method of the address electrodes 150 are not limited. The relationship among the address electrodes 150, the barriers 170, and the display electrodes 120 will be described later in more detail.

The second dielectric layer 160 covers the entire upper surface of the rear glass substrate 140 including the address electrodes 150. The second dielectric layer 160 may comprise the same or similar materials as the first dielectric layer 130. In some embodiments the second dielectric 160 may comprise different materials as the first dielectric layer 130.

The barriers 170 are positioned on a surface of the second dielectric layer 160. The barriers 170 cross over and are substantially perpendicular to the address electrodes 150 and are substantially parallel to the display electrodes 120. More particularly, a number of barriers 170 extend a length in the horizontal direction and are arranged with a pitch in the vertical direction. The barriers 170 maintain the spacing between the front and rear glass substrates 110 and 140 and define discharge regions. The barriers 170 may comprise low-melting point glass power paste or an equivalent thereof and may be formed in a screen printing method, a sandblast method, or a lift-off method, but the material or formation method of the barriers 170 are not limited.

The fluorescent layers 180 are positioned on the second dielectric layer 160 between the barriers 170 with a thickness. The fluorescent layers 180 are excited by UV rays generated during discharge and emit a color of visible light. The fluorescent layers 180 may include red, green, and blue fluorescent layers 181, 182, and 183, respectively, each formed between different barriers 170. However, the order of formation of the fluorescent layers 180 is not limited, and various orders and components thereof are possible.

Figure 5:
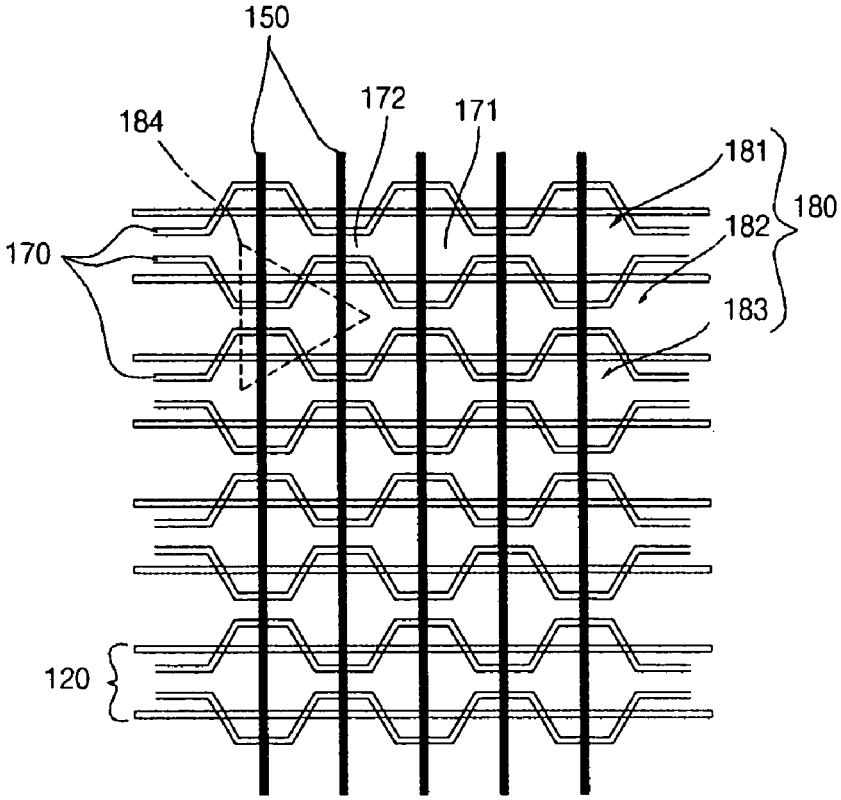
FIG. 5 is a diagrammatic view showing the relationship among address electrodes, display electrodes, and barriers of the plasma display panel shown in FIG. 4.

FIG. 5 is a diagrammatic view showing the relationship among the address electrodes, display electrodes, and barriers of the plasma display panel shown in FIG. 4.

As shown in FIG. 5, the display electrodes 120 and the barriers 170 cross and are substantially perpendicular to the address electrodes 150, and the display electrodes 120 are substantially parallel to the barriers 170.

Two adjacent barriers 170 have wider first regions 171 and narrower second regions 172 between them, which alternate in the horizontal direction. As shown, a horizontal row of alternating wider first regions 171 and narrower second regions 172 are connected such that they form a continuous region and comprise the same fluorescent layer 180. As mentioned above, the barriers 170 extend a predetermined distance in the horizontal direction in such a manner that wider first regions 171 and narrower second regions 172 alternate in the vertical direction. As shown, the alternating wider first regions 171 and narrower second regions 172 are separated by the barriers 170 and contain different fluorescent layers 180. For example, two adjacent barriers 170 may have a red fluorescent layer 181 formed between them; two adjacent barriers 170 in the next row may have a green fluorescent layer 182 formed between them; and two adjacent barriers 170 in the following row may have a blue fluorescent layer 183 formed between them. Particularly, a number of barriers 170 are arranged with an average pitch in the vertical direction. In summary, the barriers 170 define a matrix shape.

Three first regions 171 formed by the barriers 170 being closest to one another and having different fluorescent layers 180 may be defined as three sub-pixels. These three sub-pixels have substantially triangular shape. In addition, such a set of three sub-pixels may be defined as a pixel 184.

The address electrodes 150 cross and are substantially perpendicular to the longitudinal (horizontal) direction of the barriers 170, as shown. For example, a first address electrode 150 may extend in the vertical direction and cross a first region 171 formed by the horizontal barriers 170 and a second address electrode 150 may extend in the vertical direction and cross a second region 172 formed by the same horizontal barriers 170 as the first region 171 crossed by the first address electrode. The address electrodes 150 cross and are substantially perpendicular to the fluorescent layer formed between two adjacent barriers 170, e.g., red fluorescent layer 181.

More specifically, the first address electrode 150 from the left in FIG. 5 may extend in the vertical direction and cross a first region 171 (which has, for example, a red fluorescent layer 181 formed therein), a second region 172 (which has, for example, a green fluorescent layer 182 formed therein), and another first region 171 (which has, for example, a blue fluorescent layer 183 formed therein), where each of the crossed first regions 171 and second region 172 are defined by a number of barriers 170 arranged in the vertical direction.

In addition, the second address electrode 150 from the left in FIG. 5 may extend in the vertical direction and cross a second region 172 (which has, for example, a red fluorescent layer 181 formed therein), a first region 171 (which has, for example, a green fluorescent layer 182 formed therein), and another second region 172 (which has, for example, a blue fluorescent layer 183 formed therein).

According to this embodiment, a pixel 184 has two address electrodes 150 assigned thereto. Particularly, three sub-pixels of a single pixel may have two address electrodes 150 assigned thereto. For example, red and blue fluorescent layers 181 and 183 formed in two vertical first regions 171, respectively, may have a first address electrode 150 assigned thereto and a green address electrode 182 formed in the remaining first region 171 may have a second address electrode 150 assigned thereto. In addition, a blue fluorescent layer 183 formed in a vertical first region 171 may have a first address electrode 150 assigned thereto and green and red fluorescent layers 182 and 181 formed in two remaining first regions 171, respectively, may have a second address electrode 150 commonly assigned thereto. Furthermore, green and blue fluorescent layers 183 and 182 formed in two vertical first regions 171, respectively, may have a first address electrode 150 assigned thereto and a red fluorescent layer 181 formed in the remaining first region 171 may have a second address electrode 150 assigned thereto.

The display electrodes 120 may be positioned in the horizontal direction while being substantially parallel to one another and to the barriers 170. The display electrodes 120 include X and Y display electrodes. For example, a first display electrode 120 may extend in the horizontal direction along a red fluorescent layer 181 formed between adjacent barriers 170. A second display electrode 120 may extend in the horizontal direction along a green fluorescent layer 182 formed between next facing barriers 170. A third display electrode 120 may extend in the horizontal direction along a blue fluorescent layer 183 formed between following adjacent barriers 170.

The display electrodes 120 cross and are substantially perpendicular to the address electrodes 150. The angle of intersection between the display electrodes 120 and the address electrodes 150 or between the address electrodes 150 and the barriers 170 is not limited in the present invention and may vary as desired.

Figure 6:
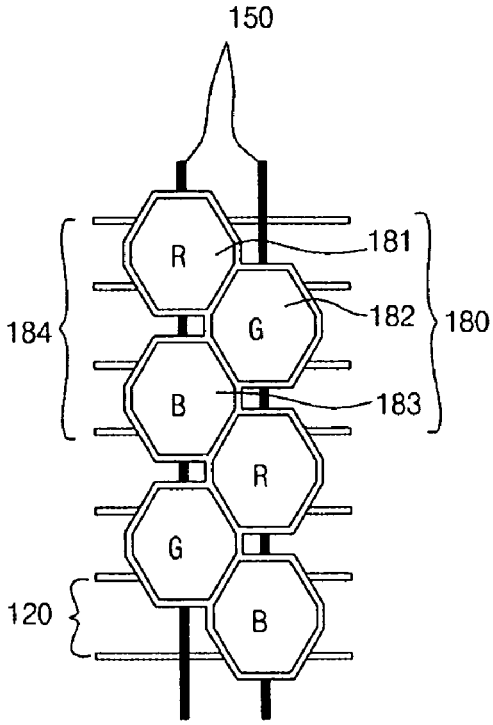
FIG. 6 is a diagrammatic view showing the relationship among address electrodes, display electrodes, and pixels of the plasma display panel shown in FIG. 4.

FIG. 6 is a diagrammatic view showing the relationship among the address electrodes, display electrodes, and pixels of the plasma display panel shown in FIG. 4. Referring to FIG. 6, a pixel 184 comprises three sub-pixels 180. The sub-pixels 180 have red, green, and blue fluorescent layers 181, 182, and 183, respectively. As mentioned above, these three sub-pixels 180 are defined by first regions 171 defined by the barriers 170. The relationship between display electrodes 120 and address electrodes 150 with respect to an individual pixel 184 follows. A pixel 184 has four display electrodes 120 and two address electrodes 150 assigned thereto.

For example, a first address electrode 150 crosses a first sub-pixel having a red fluorescent layer 181 formed therein and crosses a second sub-pixel having a blue fluorescent layer 183 formed therein and a second address electrode 150 crosses a third sub-pixel having a green fluorescent layer 182 formed therein. It is to be noted that, although three address electrodes 150 are assigned to a pixel in the prior art, two address electrodes 150 are assigned to a pixel 184 according to these embodiments. In addition, first and second display electrodes 120 cross a first sub-pixel having a red fluorescent layer 181 formed therein, second and third display electrodes 120 cross a second sub-pixel having a green fluorescent layer 182 formed therein, and third and fourth display electrodes 120 cross a third sub-pixel having a horizontal blue fluorescent layer 183 formed therein.

In summary, the number of address electrodes 150 of the plasma display panel 100 according to the present invention corresponds to about ⅔ of the prior art without degradation in resolution of the plasma display panel 100. As shown in FIG. 5, the same number (18) of sub-pixels 180 formed in a specific area while reducing the number of address electrodes 150.

As a result, the plasma display panel 100 has about ⅔ the number of address electrodes 150 as the prior art, while maintaining the same resolution. This means that power consumption is reduced to about ⅔. In addition, instantaneous power or peak power which a circuit must provide to drive the address electrodes 150 is also reduced to about ⅔ of that in the prior art. Consequently, the rate of heat emission is also significantly reduced.

As the number of electrodes 150 in the same area is reduced, the pitch among them increases. This substantially reduces cross-talk between the address electrodes 150.

Although certain embodiments have been described for illustrative purposes, those skilled in the art will appreciate that various modifications, additions and substitutions are possible, without departing from the scope and spirit of the invention.

What is claimed is:

1. A plasma display panel comprising:

a plurality of barriers defining a plurality of display regions, the plurality of display regions comprising wider regions and narrower regions, wherein the wider regions and the narrower regions alternate horizontally in rows and alternate vertically in columns, wherein each row of the horizontally alternating wider regions and narrower regions is between adjacent barriers, and the vertically alternating wider regions and narrower regions are separated by the plurality of barriers, and wherein the horizontally alternating wider regions and narrower regions of each row comprises a fluorescent layer of a same color; and at least one address electrode vertically crossing a column of vertically alternating wider regions and narrower regions, wherein adjacent wider and narrower regions crossed by the address electrode are separated by the plurality of barriers.

2. The plasma display panel as claimed in claim 1, further comprising:

a red fluorescent layer formed in a first series of horizontally alternating regions;

a green fluorescent layer formed in a second series of horizontally alternating regions; and a blue fluorescent layer formed in a third series of horizontally alternating regions.

3. The plasma display panel as claimed in claim 2, wherein two address electrodes cross at least one group of three wider regions, each of the three wider regions being adjacent to at least one other of the three wider regions, wherein the group includes the three different fluorescent layers.

4. The plasma display panel as claimed in claim 2, further comprising a plurality of pixels, wherein each pixel comprises three wider regions, each of the three wider regions being adjacent to at least one other of the three wider regions and each of the three wider regions including one of the fluorescent layers different from the fluorescent layers of the other two wider regions.

5. The plasma display panel as claimed in claim 4, wherein a first address electrode crosses first and second wider regions of a pixel and a second address electrode crosses a third wider region of the pixel.

6. The plasma display panel as claimed in claim 5, wherein the first wider region includes the red fluorescent layer the second wider region includes the blue fluorescent layer, and the third wider region includes the green fluorescent layer.

7. The plasma display panel as claimed in claim 5, wherein the first wider region includes the blue fluorescent layer the second wider region includes the green fluorescent layer, and the third wider region includes the red fluorescent layer.

8. The plasma display panel as claimed in claim 5, wherein the first wider region includes the green fluorescent layer the second wider region includes the red fluorescent layer, and the third wider region includes the blue fluorescent layer.

9. The plasma display panel as claimed in claim 1, wherein the address electrodes are substantially perpendicular to the barriers.

10. The plasma display panel as claimed in claim 1, further comprising a plurality of display electrodes arranged substantially perpendicular to the address electrodes.

11. The plasma display panel as claimed in claim 1, further comprising:

a front glass substrate;

at least one display electrode formed on the front glass substrate;

a first dielectric layer covering the display electrode;

a rear glass substrate positioned substantially parallel to the front glass substrate;

at least one address electrode formed on the rear glass substrate and configured to cross the display electrode;

a second dielectric layer covering the address electrode; and a plurality of barriers formed on the second dielectric layer to be substantially perpendicular to the address electrode.

12. A plasma display panel device configured to display first, second and third colors, the device comprising:

a plurality of barriers defining a plurality of rows of display regions, wherein each row comprises a plurality of alternating wider display regions and narrower display regions configured to collectively emit light of no more than one of the first color, the second color, and the third color; and a single address electrode arranged such that the single address electrode crosses at least one display region configured to emit light of the first color, at least one display region configured to emit light of the second color, and at least one display region configured to emit light of the third color.

13. The plasma display panel as claimed in claim 12, wherein the address electrode is substantially linear near the display regions.

14. The plasma display panel as claimed in claim 12, wherein the display regions are substantially hexagonal.

15. The plasma display panel as claimed in claim 12, further comprising a plurality of pixels, wherein each pixel comprises three display regions, each of the three display regions being adjacent to at least one other of the three display regions and each of the three display regions being configured to emit light of a different color.

16. The plasma display panel as claimed in claim 15, wherein a first address electrode crosses first and second display regions of a pixel and a second address electrode crosses a third display region of the pixel.

17. The plasma display panel as claimed in claim 15, wherein each of the three display regions of a pixel is adjacent to the other two display regions within the pixel.

18. The plasma display panel as claimed in claim 12, wherein the address electrode is substantially perpendicular to the barriers.

19. The plasma display panel as claimed in claim 12, further comprising a plurality of display electrodes arranged substantially perpendicular to the address electrode.

20. The plasma display panel as claimed in claim 12, further comprising:

a front glass substrate;

at least one display electrode formed on the front glass substrate;

a first dielectric layer covering the display electrode;

a rear glass substrate positioned adjacent to the front glass substrate; and a second dielectric layer covering the address electrode, wherein the plurality of barriers are positioned on the second dielectric layer substantially perpendicular to the address electrode.

* * * * *